US005275238A

United States Patent [19]

Cameron

[11] Patent Number: 5,275,238

[45] Date of Patent: Jan. 4, 1994

[54] DOWNHOLE PUMP ASSEMBLY

[76] Inventor: Antony D. Cameron, 45 Deeside Gardens, Aberdeen, AB1 7PP, Great Britain

[21] Appl. No.: 875,123

[22] Filed: Apr. 28, 1992

[51] Int. Cl.[5] ..... E21B 43/00

[52] U.S. Cl. ..... 166/105; 166/242; 417/423.14; 418/48

[58] Field of Search ..... 166/105, 106, 242; 417/423.14; 418/48

[56] References Cited

U.S. PATENT DOCUMENTS

| | | | |
|---|---|---|---|
| 3,800,871 | 4/1974 | Watson | 166/250 |
| 4,386,654 | 6/1983 | Becker | 166/105.5 |
| 4,614,232 | 9/1986 | Jürgens et al. | 166/106 X |
| 4,898,244 | 2/1990 | Schneider et al. | 166/297 |
| 5,097,902 | 3/1992 | Clark | 418/48 X |

*Primary Examiner*—Terry Lee Melius
*Attorney, Agent, or Firm*—Ratner & Prestia

[57] ABSTRACT

A downhole pump assembly is provided for use in a fluid production line, the assembly comprising a pump disposed around a fixed central conduit for connection in said production line to provide direct access for monitoring means through the pump.

16 Claims, 3 Drawing Sheets

DOWNHOLE PUMP ASSEMBLY

This invention relates to a downhole pump assembly.

In oil-drilling operations, artificial lift of the oil from the oil bed may be necessary if the pressure of the deposit is insufficient to bring the oil to the surface. Downhole pumps can be used to pump the oil to the surface.

It is often desirable to make provision in a pumped well completion to pass wireline tools beyond the pump to perform various well management operations and, importantly, to log the well and monitor performance with the pump running. This is usually achieved by clamping by-pass tubing to the side of the pump and motor in a manner such as that described in, for example, U.S. Pat. No. 4 898 244 (Schneider and Barcia). However, because of the bypass there is limited space in the casing for the pump assembly; the diameter of the pump and motor is decreased and to maintain the same level of performance a longer pump assembly is required. Frequently, a bypass downhole pump assembly will be more than 30 m in length.

Alternatively, a pump having a hollow shaft has been developed using "canned" modular units to provide the required performance.

Typically, three such units are required necessitating three blanking plugs of successively reducing diameters. Thus, the size of tools which can pass through will be restricted by the smallest diameter. Production logging will not be possible due to the bore of the shaft being live. The use of multiple pump units necessitates multiple connections for the supply of electrical power.

U.S. Pat. No. 3 800 871 (Watson) describes a tubing anchor which is in line with downhole pumping apparatus and which allows uninterrupted passage of a logging tool such as a probe through the anchor. The probe passes down the borehole externally of the pump, and the borehole must therefore be of sufficient width as to allow the side-by-side passage of the pump and the probe.

According to the present invention there is provided a downhole pump assembly for use in a fluid production line having a main axis, comprising a first tube having attachment means at either end for connection in the production line, a second tube within the first tube, and pumping means disposed between the first and second tubes, said second tube being fixed with respect to the first tube and axially aligned with the production line, and said second tube providing a passageway for monitoring means.

Most preferably said monitoring means are logging tools which may be lowered directly into well fluid through the second tube.

The pumping means may comprise, for example, a centrifugal pump to move fluid along the production line. A motor for driving the pump may be provided adjacent the pump.

Pumping means may alternatively comprise an axial flow or multi-stage turbine pump.

Alternatively, pumping means may be provided as a kinetic pump comprising a stator and a rotor, one being helically threaded and the other being provided with a channelled surface, the stator and rotor co-operating to provide, on rotation of the rotor, a system for moving fluid longitudinally between them.

Preferably, there is working clearance between the rotor and stator and one of the stator and rotor may provide bearing support for the other.

Preferably, the rotor is threaded on its outer face and rotates within the stator, which preferably is also threaded on its inner face in opposite-hand to the rotor. Alternatively, one of the rotor and stator can be threaded and the other longitudinally channelled, or channelled in a series of rings, or threaded in the same hand to the other but at different pitch. Most preferably the thread or threads are multistart.

Preferably, the stator comprises an elastomer and the rotor comprises a metal such as wear-resistant steel. An advantage of the use of such a combination of materials is that particles such as grit or sand are entrained within the moving fluid without causing damage to the pump assembly.

Plugging means may be provided for preventing fluid from the pump re-circulating through the second tube.

Because the second tube is fixed the downhole pump assembly may receive cables and equipment for the logging tools before the pumping operation starts and retain said cables when the pump is in operation, once the plugging means is in place. Said plugging means may be capable of allowing the cables to extend through it without losing its function as a plug.

An example of such a plugging means is a standing plug which sits above a no-go nipple that extends into the second tube.

Preferably, said first tube comprises a cylindrical outer casing.

Said downhole pump assembly may be provided as a unit or as a set of parts which may be assembled in situ.

Embodiments of the invention will now be described by way of example with reference to the accompanying drawings in which.

Figure 1:
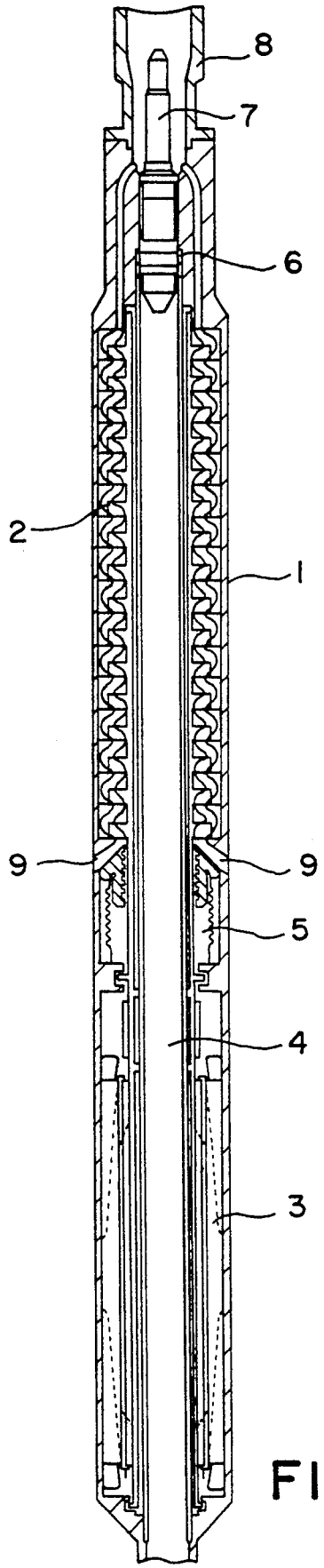
FIG. 1 is a longitudinal sectional view of a first embodiment of a downhole pump assembly according to the present invention.

A first embodiment of a downhole pump assembly comprises a cylindrical outer casing 1, pumping means in the form of a multi-stage centrifugal pump section 2 and motor 3 which surround a central conduit 4 (internal diameter 5.99 cm) said conduit 4 being fixed with respect to the cylindrical outer casing 1 and axially aligned with an oil production line (not shown). The central conduit 4 gives access from a wellhead for monitoring means such as logging tools (not shown). A seal section 5 prevents flow of well fluid into the motor 3, and a no-go nipple 6 (internal diameter 5.77 cm) and standing plug 7 form plugging means which seal the central conduit 4. A bolt-on head is provided at 8. Ports 9 are provided in the cylindrical outer casing 1 to admit fluid to the pump section 2.

The central conduit 4 is fixed at either end to the cylindrical outer casing 1, and thus does not rotate and is a direct path to the well fluid below the pump. The central conduit 4 allows logging tools to be lowered by wireline directly into the well fluid along the conduit, thus allowing changes in well conditions to be monitored during oil production. Cables (not shown) for the logging tools run through the plugging means, and both the plugging means and the tools can be lowered down the conduit 4 before starting the motor. The cables are safely encased in the conduit away from the centrifugal pump section 2.

Figure 2:
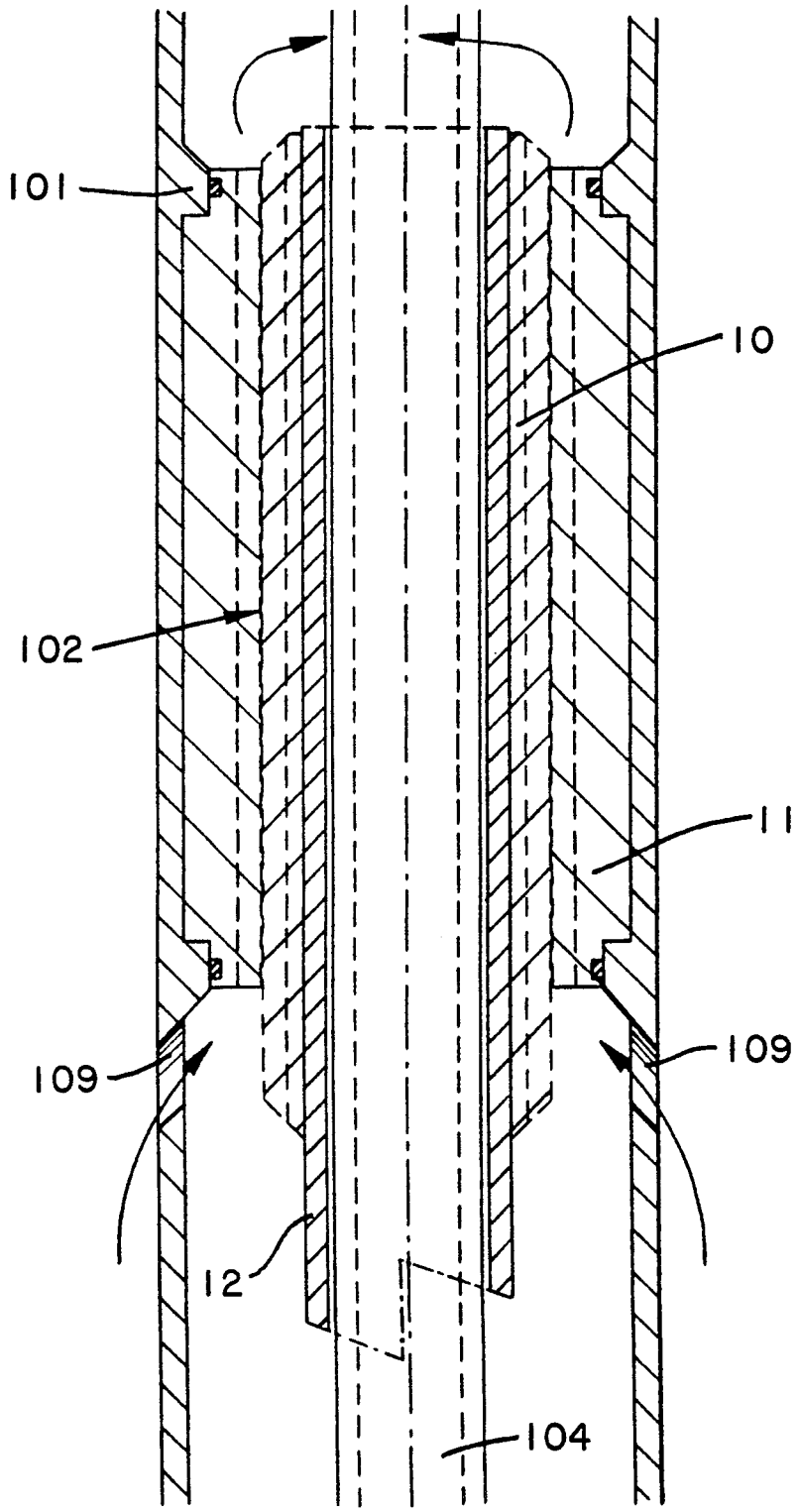
FIG. 2 is a longitudinal sectional view of a second embodiment of a pump section of a downhole pump assembly according to the present invention.
Figure 3:
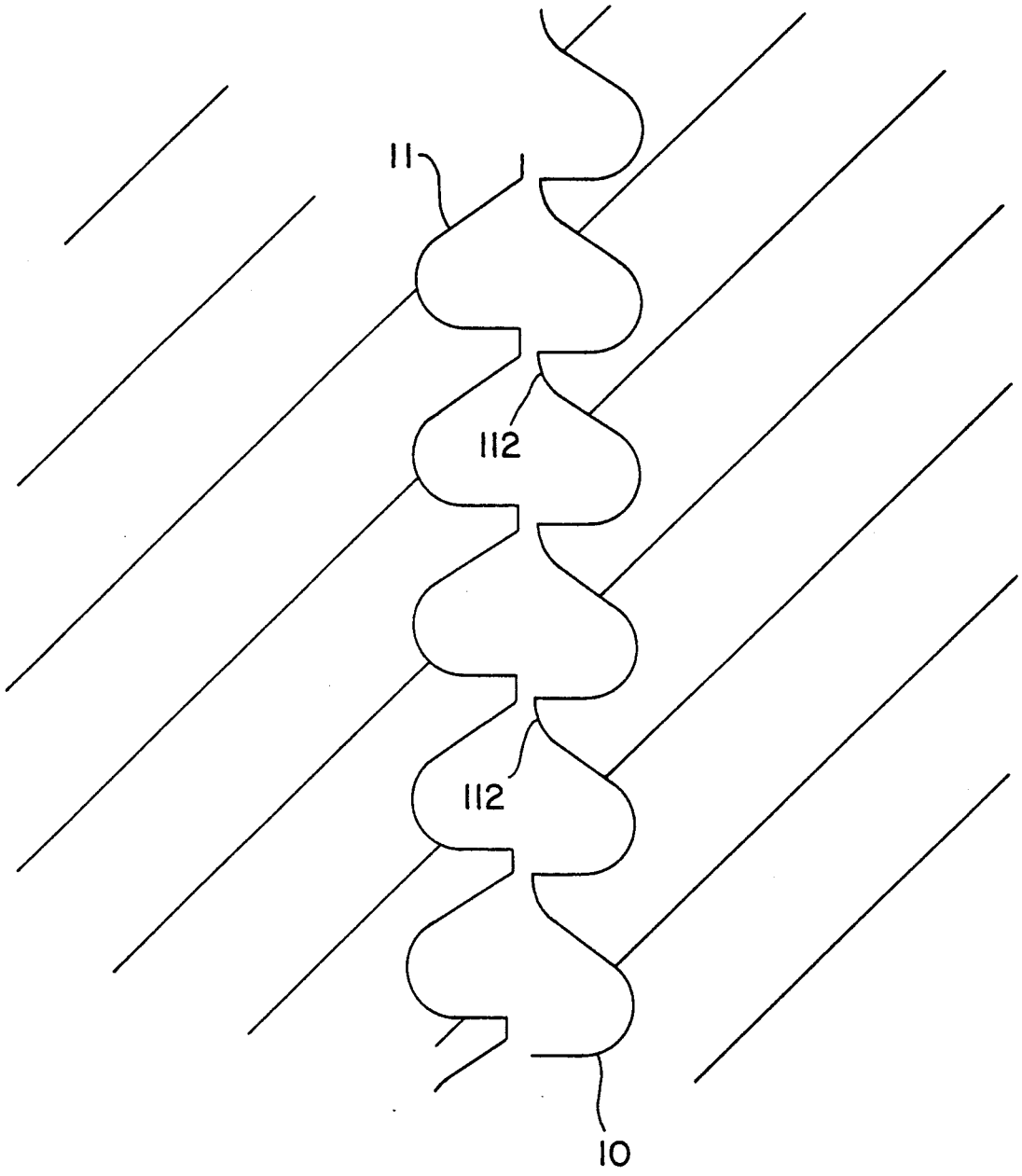
FIG. 3 is an enlarged view of the opposed faces of the stator and rotor of the pump section of FIG. 2.

A second embodiment of a pump section of a downhole pump assembly is shown in FIGS. 2 and 3. In this embodiment similar parts are numbered as in FIG. 1 plus 100, i.e. 2 becomes 102.

The centrifugal pump section 2 of FIG. 1 is replaced in this embodiment by a kinetic pump 102 which comprises an annular rotor 10 surrounding the central conduit 104 and an annular stator 11 co-axial with and extending around the rotor 10. The rotor 10 is externally screw-threaded in a right-handed sense and the stator 11 is internally screw-threaded in a left-handed sense. The threads of the rotor 10 and stator 11 are of equal pitch and both have a double start and, as shown in FIG. 3, the crests approach each other sufficiently closely to provide between them chambers within which oil can be retained for upward movement on rotation of the rotor 10. In the rotor the trailing edges 112 of the threads are radiussed to reduce or prevent cavitation during operation of the pump.

The rotor 10 is locked onto a drive sleeve 12 extending from the motor (not shown).

The performance of a pump as shown in FIGS. 2 and 3 is determined by the cross-sectional area of the threads or grooves, their pitch or helix angle, and the overall length of the rotor within the stator. Generally, the greater the cross-section and the steeper the pitch, the greater the volume, and the less the pressure developed per unit length. The overall pressure head is directly proportional to the active length.

It has been found that a pump in accordance with FIGS. 2 and 3 which is 5 inches long and has an effective diameter across the interface between the rotor and stator of 2 inches will produce 11 gallons per minute at 10 psi when operated at a speed of 3480 revolutions per minute. When the diameter is 4.5 inches and the pump is run at 3480 revs per minute the production is 55 gallons per minute at a pressure of 10 psi per inch of length.

It has been found that use of a coarser thread on the rotor/stator assembly is unexpectedly effective in improving the output of the pump.

A further alternative to the pumps shown in FIGS. 1, 2 and 3 is an axial flow or multi-stage turbine pump (not shown).

Some of the advantages of these embodiments of the invention are as follows:

A. The pump and motor have a greater diameter than dual systems, which allows what is in effect an integral bypass system rather than one that is clamped onto the side of a downhole pump. The greater diameter of the pump assembly means that it has greater performance and so the length of the cylindrical outer casing can be shorter; e.g. less than 9 m instead of 36 m as in the prior art. The pump section of these embodiments can be made to a length to provide head required and within a drift diameter of 216.5 mm to suit the standard casing size of 244.5 mm diameter×70 kg/m. As a result, these embodiments can be easily installed on site. It is also less vulnerable during transit as it can be provided as a factory assembled unit, instead of sections for assembly offshore.

B. The standing plugs and no-go nipple sizes referred to in these embodiments are standard sizes used in the industry, which means that these embodiments of the invention are readily usable.

C. It has been suggested that the previous modular designs could cope with wireline operations if equipped with flap valves or removable plugs in the central through bores. However, as the hollow shafts rotate production logging cannot be performed. Because a string of two or three modules is used, each module must be electrically connected to the next which results in a large number of entry and exit cable connectors and increases the complexity of the assembly operation and the chances of error or breakdown occurring.

The described embodiments of the present invention have unitary electrical connections, straightforward installation, and permit a full range of wireline operations.

Modifications and improvements may be made without departing from the scope of the invention.

I claim:

1. A downhole pump assembly for use in a fluid production line having a main axis, comprising a first tube having attachment means at each end for connection in the production line, a second tube within the first tube, and pumping means disposed between the first and second tubes, said second tube being fixed with respect to the first tube and axially aligned with the production line to provide a continuous, stationary passageway for through passage of monitoring means, whereby said monitoring means may be continuously operated without interruption through the stationary passageway.

2. A downhole pump assembly as claimed in claim 1, wherein said monitoring means are logging tools which may be lowered directly into well fluid through the second tube.

3. A downhole pump assembly as claimed in claim 1, wherein the pumping means comprises an axial flow or multi-stage turbine pump.

4. A downhole pump assembly as claimed in claim 3, wherein the axial flow or multi-stage turbine pump is driven by a motor adjacent the pump.

5. A downhole pump assembly as claimed in claim 1, wherein the pumping means comprises a centrifugal pump.

6. A downhole pump assembly as claimed in claim 5, wherein the centrifugal pump is driven by a motor adjacent the pump.

7. A downhole pump assembly as claimed in claim 1, wherein the pumping means is provided as a kinetic pump, comprising a stator and a rotor, one of the stator and rotor being helically threaded and the other being provided with a channelled surface, the stator and rotor co-operating to provide, on rotation of the rotor, a system for moving fluid longitudinally between them.

8. A downhole pump assembly as claimed in claim 7, wherein one of the stator and rotor provides bearing support for the other.

9. A downhole pump assembly as claimed in claim 7, wherein the rotor is threaded on its outer face and rotates within the stator.

10. A downhole pump assembly as claimed in claim 9, wherein the stator is threaded on its inner face in opposite-hand to the rotor.

11. A downhole pump assembly as claimed in claim 10, wherein the thread on the stator and the thread on the rotor are multiple start.

12. A downhole pump assembly as claimed in claim 7, wherein the stator comprises an elastomer and the rotor comprises a metal.

13. A downhole pump assembly as claimed in claim 1, wherein the second tube has plugging means for preventing fluid from the pump entering the second tube.

14. A downhole pump assembly as claimed in claim 13, wherein said plugging means is a standing plug which sits above a no-go nipple that extends into the second tube.

15. A downhole pump assembly as claimed in claim 1, wherein the first tube is provided as a cylindrical outer casing.

16. A downhole pump assembly for use in a fluid production line having a main axis, comprising a first tube having attachment means at each end for connection in the production line, a second tube within the first tube, pumping means disposed between the first and second tubes, said second tube being fixed with respect to the first tube and axially aligned with the production line to provide a continuous, stationary passageway for through passage of monitoring means, and plugging means disposed within the second tube for preventing fluid from the pump entering the second tube.

* * * * *